US007370637B2

(12) United States Patent
Jay et al.

(10) Patent No.: US 7,370,637 B2
(45) Date of Patent: May 13, 2008

(54) ARRANGEMENT IN FUEL INJECTION APPARATUS

(75) Inventors: David C. Jay, Vähäkyrö (FI); Daniel Paro, Kvevlax (FI)

(73) Assignee: Wartsila Finland Oy, Vaasa (FI)

( * ) Notice: Subject to any disclaimer, the term of this patent is extended or adjusted under 35 U.S.C. 154(b) by 0 days.

(21) Appl. No.: 10/560,656

(22) PCT Filed: Jun. 10, 2004

(86) PCT No.: PCT/FI2004/050089

§ 371 (c)(1),
(2), (4) Date: Apr. 5, 2006

(87) PCT Pub. No.: WO2004/111438

PCT Pub. Date: Dec. 23, 2004

(65) Prior Publication Data

US 2006/0219804 A1 Oct. 5, 2006

(30) Foreign Application Priority Data

Jun. 17, 2003 (FI) ..... 20030911

(51) Int. Cl.
*F02M 37/04* (2006.01)

(52) U.S. Cl. ..... 123/467; 123/446

(58) Field of Classification Search ..... 123/446, 123/456, 506, 467, 500, 501
See application file for complete search history.

(56) References Cited

U.S. PATENT DOCUMENTS 2,612,841 A * 10/1952 Lasley ..... 417/501
2,918,048 A * 12/1959 Aldinger et al. ..... 123/459
4,074,668 A 2/1978 Indra
4,077,376 A * 3/1978 Thoma ..... 123/467
4,201,170 A * 5/1980 Overfield ..... 123/506
5,390,692 A * 2/1995 Jones et al. ..... 137/513.3
6,644,278 B2 * 11/2003 Harndorf ..... 123/446
7,040,293 B2 * 5/2006 Furukubo et al. ..... 123/467
7,178,510 B2 * 2/2007 Askew et al. ..... 123/506
2002/0170535 A1 * 11/2002 Brenk et al. ..... 123/446

FOREIGN PATENT DOCUMENTS

DE 19834763 3/2000
EP 0325858 8/1989
EP 0855504 7/1998

* cited by examiner

*Primary Examiner*—Carl S. Miller
(74) *Attorney, Agent, or Firm*—Smith-Hill and Bedell

(57) ABSTRACT

An arrangement in the fuel injection system for controlling the fuel injection, the arrangement comprising a body part with a space arranged therein, through which space the fuel to be injected flows during operation, the space further having an inlet opening and an outlet opening therein. The arrangement further comprises a piston means, arranged movably in the space and a flow path for creating a flow connection between the fuel inlet and the fuel outlet openings. The flow path comprises at least one throttling portion opening into the space of the body part, the cross-sectional flow area of the throttling portion being defined by the relative positions of the piston means and the body part.

9 Claims, 4 Drawing Sheets

ARRANGEMENT IN FUEL INJECTION APPARATUS

This is a national stage application filed under 35 USC 371 based on International Application No. PCT/FI2004/050089 filed Jun. 10, 2004, and claims priority under 35 USC 119 of Finnish Patent Application No. 20030911 filed Jun. 17, 2003.

The present invention relates to an arrangement in a fuel injection apparatus.

Common rail injection systems utilizing pressure accumulators are commonly used in connection with piston engines. In such systems the fuel stored in injection pressure in the so-called pressure accumulator is injected into the combustion chamber of the engine by controlling the injector valve.

In a typical common rail system the injection pressure reaches a high pressure level almost instantaneously when the needle of the injector nozzle opens. As a result of this, the fuel mass flow is great right at the beginning of the injection during injection of fuel into the combustion chamber. In such a case the pressure in the combustion chamber can increase too fast for reaching optimum performance.

It is an aim of the present invention to produce an arrangement in the fuel injection apparatus minimizing the problems associated with prior art. It is an especial aim of the present invention to produce an arrangement for efficiently but simply having an effect on the fuel injection procedure.

The aims of the invention can be achieved by the methods mainly disclosed in claim 1 and more closely disclosed in the dependent claims.

According to the invention, an arrangement in the fuel injection system for controlling the fuel injection comprises a body part with a space arranged therein, through which space the fuel to be injected flows during operation, the space further having an inlet and an outlet opening therein. The arrangement further comprises a piston means or the like, arranged movably in the space and the arrangement having a flow path for creating a flow connection between the fuel inlet and the fuel outlet openings. The flow path comprises at least one throttling portion, opening into the space of the body part, the cross-sectional flow area through which throttling portion fuel can flow, is determined by the mutual positions of the piston means and the body part. The throttling portion is arranged to be increasing while the piston means is moving in respect to the body part at the beginning of the injection.

The throttling portion comprises a number of openings arranged in the piston means in various places along the longitudinal axis thereof, and a control edge, the mutual position of the openings and the control edge defining the total cross-sectional flow area of the fuel flow path. The control edge is formed by a limit area, in which limit area the inner surface of the body part and the outer surface of the piston means are released from contact with each other or from other influence throttling the flow.

According to one embodiment the throttling portion comprises at least one hole arranged in the piston means, the hole being elongated in the longitudinal direction thereof.

According to another embodiment the piston means comprises an actuator operating independently from the fuel pressure, whereby the increase of fuel pressure can be efficiently controlled depending on the operating state of the engine. A damping space and a channel are provided in connection with the other end of the piston means, the channel connecting the space arranged in the body part to the damping space. The spring of the piston means is preferably arranged in the damping space, whereby no separate space for a spring is needed. The piston means is preferably formed of a tubular piece, the wall thickness of which is smaller than the inside diameter of the piece.

The arrangement according to the invention allows limiting the mass flow of the fuel injected in the beginning of the injection while allowing a sufficient injection pressure during the actual injection.

In the following the invention is described by way of example and with reference to the appended schematic drawings, of which FIG. 1 shows the arrangement according to the invention being applied to the fuel injection system of an engine;

The reference numbers used in the figures correspond with each other as far as possible for maintaining clarity. Moreover, all parts in practice belonging to the system are not necessarily described here, if their description is not essential as far as understanding the invention is concerned.

Figure 1:
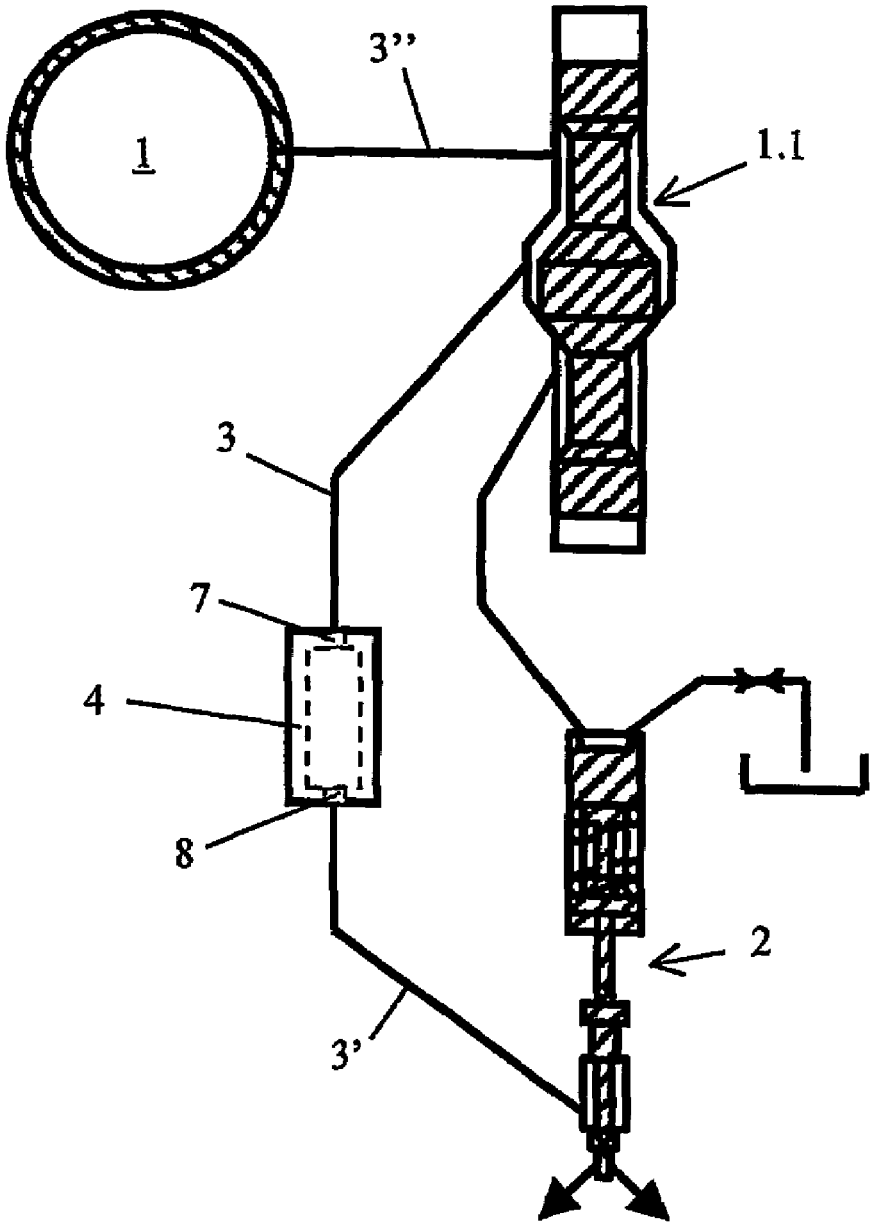

FIG. 1 shows very schematically how the arrangement 4 according to the invention can be arranged in connection with a common rail fuel injection system of an internal combustion engine. The fuel injection system is only described to the extent necessary for operation the invention. The fuel injection system based on a common rail comprises as its main components the common rail, i.e. pressure accumulator 1, in which fuel is in high pressure to be injected into the combustion chamber of the engine and with which the injection valve 2 is in flow connection. A fuel channel system 3, 3', 3" has been arranged from the common rail 1 to injection valve 2 metering the fuel to each cylinder (not shown). During operation, a sufficient pressure is maintained in the common rail for achieving sufficient injection pressure for the injection valve 2. Each injection valve 2 comprises control means 1.1 for independently controlling the fuel injection. Here, the pressure accumulator 1 of the fuel injection system is connected by means of a channel 3" to control means 1.1, from which fuel is fed to injection valve 2 further via channel system 3, 3'. The control means here operate so that the pressure of the pressure accumulator, i.e. the flow connection to the pressure accumulator, can be connected to the injection valve for injecting fuel into the engine and also to the apparatus closing the injection valve for closing the valve. An arrangement 4 has been connected to the fuel channel system 3, 3' via the fuel inlet opening 7 and the outlet opening 8 thereof. The operation of the arrangement 4 is in the following described with reference to FIGS. 2-5.

Figure 2:
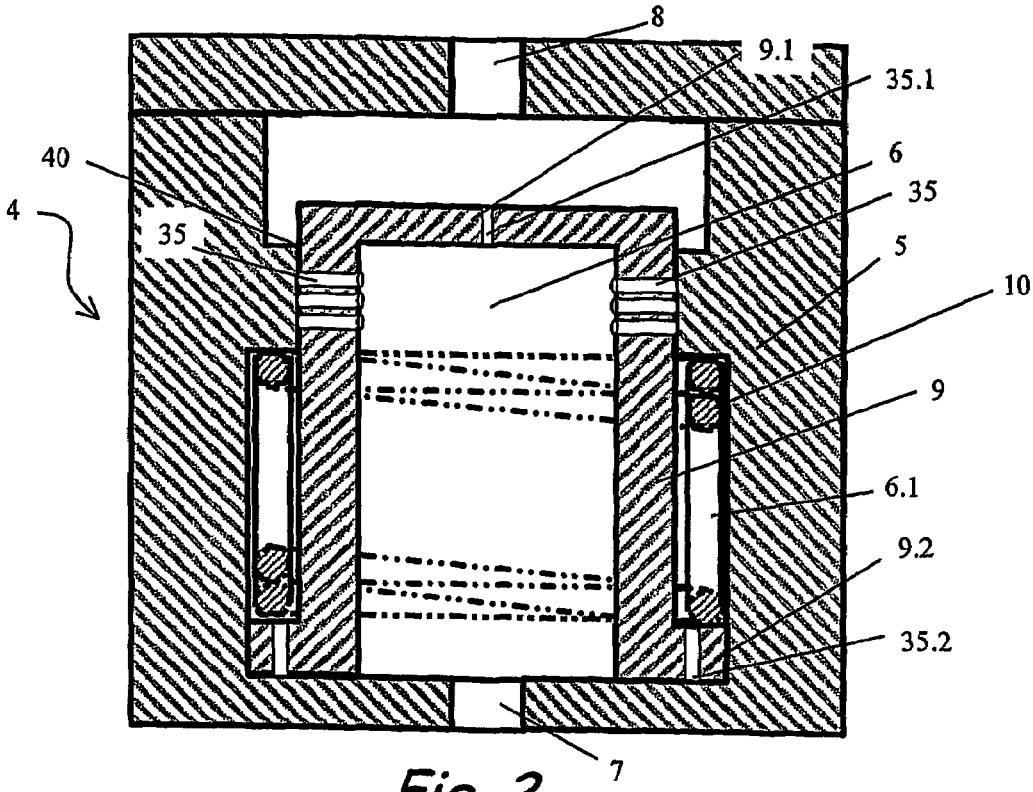
FIG. 2 shows an arrangement according to the invention in the initial state.

FIG. 2 shows an advantageous embodiment of the arrangement 4 in a fuel injection apparatus according to the invention for controlling the fuel injection. The arrangement comprises a body part 5, into which is arranged a space 6. When the engine runs, fuel flows through this space 6. A piston means 9 is also arranged inside the space 6, being arranged movably against the power produced by spring 10. The fuel inlet opening 7 and outlet opening 8 are also in flow connection with the space 6. The piston also means divides the space 6 in two parts, the side of the inlet opening 7 and the outlet opening 8. A fuel flow pach has been formed between the inlet opening 7 and the outlet opening 8 by means of the combined effect of the channels and the spaces. The piston means 9 is a tubular part provided with a wall 9.1 on one end and an external shoulder 9.2 on the other end. It can also be understood as a piston means having a longitudinal bore. The wall 9.1 comprises a smallish opening 35.1 that allows, among others, the levelling of fuel pressure and the return of the piston means 9 to its initial position subsequent to the injection procedure. In order to accomplish the return subsequent to the injection procedure the arrangement comprises a spring 10. There is also channel 35.2 in connection with the second end of the piston means and its shoulder 9.2, the channel connecting the space 6 to the damping space 6.1 formed for the spring 10 of the piston means.

Openings 35 have been arranged in the piston means 9, the openings also forming a part of the flow path. The openings extend from the inner part of the piston means to its outer surface. A number of openings 35 arranged in the longitudinal direction of the piston means are shown here, but the shape and number thereof is always chosen to suit each application. The fuel can pass through openings 35 from the inlet opening 7 to the outlet opening depending on the position of the piston means.

Figure 3:
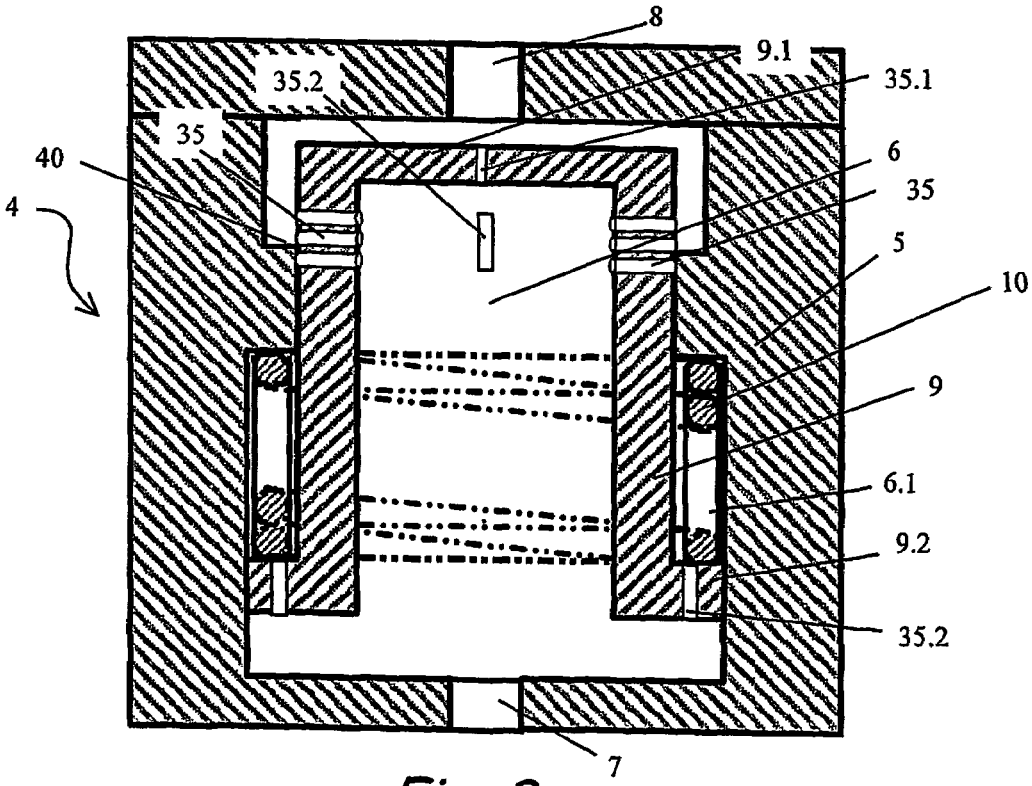
FIG. 3 shows the arrangement of FIG. 2 in a second extreme situation.

The situation before the injection is shown in FIG. 2. Here, the piston means 9 is in its initial position at the end adjacent the fuel inlet opening 7. Thus, the openings 35 of the piston means 9 are on the upstream side of the control edge of the body part 5 and against the body part, which essentially covers all the openings 35 arranged in the wall of the shell of the piston means. When the injection valve 2 is opened, the fuel pressure in the end adjacent the outlet opening 8 is smaller than in the end adjacent the inlet opening 7 and the piston means 9 starts to move. When the piston means moves, the emptying of fuel from the damping space 6.1 via channel 35.2 on its part slows down the movement of the piston while slowing down the increase of the injection pressure to its maximum. FIG. 3 shows the arrangement according to FIG. 2 in a situation, in which the fuel injection has already started. Here, a control edge 40 has been formed in the body part 5. When the openings 35 of the piston means 9 pass the control edge, the pressure in the end adjacent the outlet opening 8 starts to increase faster according to how the flow area of the throttling portion increases as the openings move past the control edge 40 and open into the part of the space 6 adjacent the outlet opening 8. The closer to the outlet opening 8 the piston means moves, the more of the openings can allow fuel to flow through it, whereby the injection pressure increases. FIG. 3 shows a long opening 35.2 extending longitudinally along the piston means as an alternative form.

In the beginning of the injection procedure the total cross-sectional area of the openings is very small, whereby the fuel mass flow is considerably limited by the throttling effect produced thereby. As the piston means move, a larger portion of the area of the openings 35 is opened and the area of the throttling portion of the flow path increases, whereby also the injection pressure, i.e. fuel pressure on the outlet side increases. The area of the openings 35 is chosen such that it does not considerably limit the fuel flow at least at the end of the injection, in other words the pressure loss is small. By suitably choosing the location of the openings 35 along the longitudinal axis and their cross-sectional area the speed of fuel pressure increase and its phasing can be effected as desired.

Figure 4:
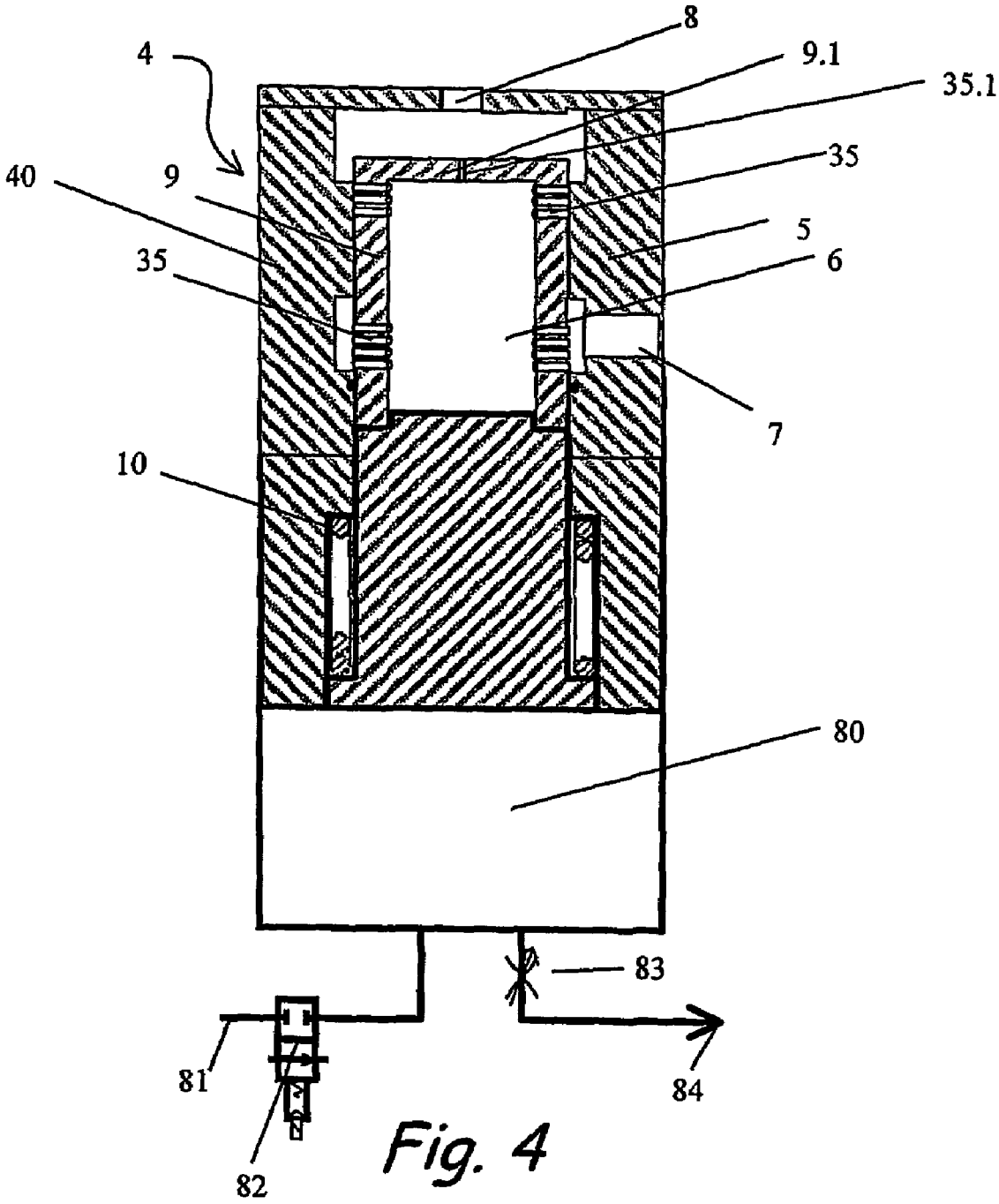
FIG. 4 shows another arrangement according to the invention.

FIG. 4 shows an embodiment otherwise corresponding to FIG. 2, but here the movement and position of the piston means 9 are determined by a separate actuator 80 instead of the fuel pressure, the actuator controlling the piston means 9. The actuator 80 is preferably connected to the servo oil system 81 of the engine by means of a solenoid-operated two-way valve 82. Thus, the movement of the piston means 9 can be controlled irrespective of the fuel pressure. The servo oil system connected to the actuator 80 is connected to the return channel 84 via a separate throttling means 83. The throttling portion 83 can also be adjustable. The effect of the throttling means 83 to the servo oil pressure in the actuator 80 controls the speed of the movement of piston means 9, whereby the operation of the piston means can be set differently in, for example, different running condition of the engine.

Figure 5:
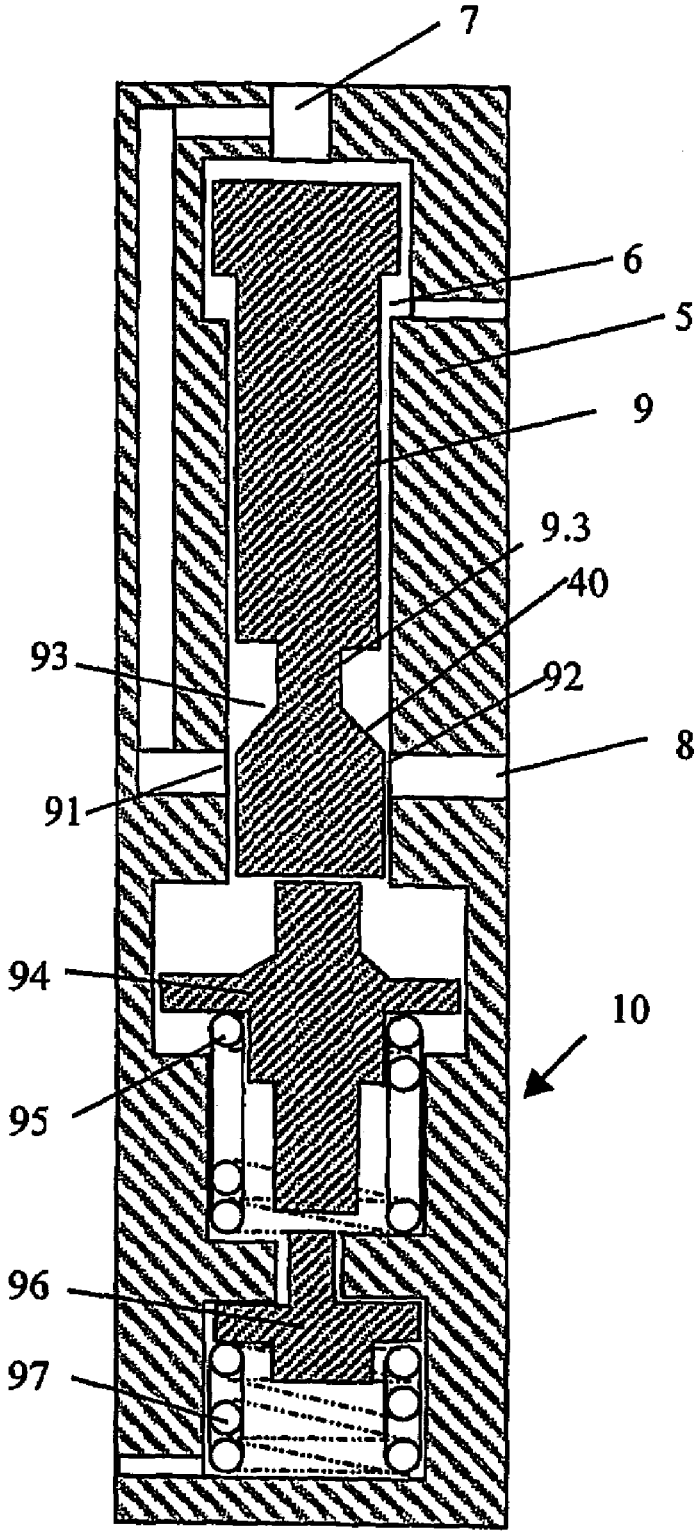
FIG. 5 shows yet another arrangement according to the invention.

FIG. 5 shows another embodiment of the arrangement according to the invention. Here, the body part 5 is also provided with a cylindrical space 6 for a piston means 9. A portion 9.3 having a smaller diameter than the main portion of the piston means has been arranged on the portion between the ends of the piston means 9, the portion comprising a conical control edge 40. Thus, the control edge consists of a portion in which the diameter of the piston means changes in the direction of its longitudinal axis. This can be stepwise or suitably continuous, either linearly or non-linearly. The said portion 9.3 having a smaller diameter forms a volume 93 in space 6, via which volume the fuel to be fed in the engine is arranged to flow. The fuel inlet opening 7 is in connection with the space formed by the other end of the piston means and the body part 5, which enables the force effect caused by the fuel pressure to act on the piston means 9. This causes the movement of the piston means. A channel 91 has been formed to open from the fuel inlet opening 7 into the volume 93 and further from the volume 93 to the channel 92 formed by the flow path to the fuel outlet opening 8. The conical control edge 40 controls the fuel flow depending on the position of the piston means in relation to channels 91 and 92. A spring arrangement 10 is located in the end of the piston means 9 opposite to the fuel inlet opening 7, the spring arrangement being formed by two separate spring systems, whereby the spring system operates in two phases. The first piston piece 94 of the spring system is loaded against the first spring 95. As the piston means 9 moves downward, i.e. away from the fuel inlet opening, in the situation shown in the figure, only the first spring causes a force against the movement of the piston means 9, in other words the movement of the piston is relatively fast. The movement causes the control edge 40 to move and the channels 91 and 92 open into the space 93, thus increasing the fuel flow. When the piston means 9 and the piston piece 94 have moved together for a certain distance, the piston piece 94 meets another piston piece 96 of the spring system, the spring 95 of which here starts to act on the movement of the piston means 9. Subsequent to this, the speed of the piston means decreases.

The invention is not limited to the embodiments described here, but a number of modifications thereof can be conceived of within the scope of the appended claims. For example, different geometries of the piston means can be considered.

The invention claimed is:

1. A common rail fuel injection apparatus for controlling fuel injection, comprising:

a body part defining an interior space and also defining a fuel inlet and a fuel outlet that open respectively into and from said interior space, whereby fuel to be injected in operation of the fuel injection apparatus flows through said interior space, a piston means movable in said interior space alternately towards and away from the fuel outlet, the piston means dividing the interior space of the body part into an inlet chamber into which the fuel inlet opens and an outlet chamber from which the fuel outlet extends, and the piston means and the body part defining a damping space in communication with the inlet chamber, and a spring located in the damping space for urging the piston means towards the fuel inlet, wherein the apparatus provides flow connection between the fuel inlet and the fuel outlet by at least a first flow path that provides continuous flow connection and a second flow path of which the cross-sectional flow area increases when the piston means moves towards the fuel outlet.

2. A common rail fuel injection apparatus according to claim 1, wherein said second flow path includes a plurality of passages formed in the piston means and spaced apart along an axis of movement of the piston means.

3. A common rail fuel injection apparatus according to claim 1, wherein the piston means has an internal chamber that forms at least part of said inlet chamber and also has an external surface that bounds said outlet chamber, said second flow path includes a plurality of passages formed in the piston means and extending from said internal chamber to said external surface, and said passages are spaced apart along an axis of movement of the piston means.

4. A common rail fuel injection apparatus according to claim 1, wherein said second flow path includes a passage formed in the piston means and elongated along an axis of movement of the piston means.

5. A common rail fuel injection apparatus according to claim 1, wherein the piston means has an internal chamber that forms at least part of said inlet chamber and also has an external surface that bounds said outlet chamber, said second flow path includes a passage formed in the piston means and extending from said internal chamber to said external surface, and said passage is elongated along an axis of movement of the piston means.

6. A common rail fuel injection apparatus according to claim 1, wherein the body part has a control edge, on one side of the control edge the piston means is in contact with the body part and on an opposite side of the control edge the piston means is spaced from the body part, and movement of the piston means past the control edge effects change in the cross-sectional area of the second flow path.

7. A common rail fuel injection apparatus according to claim 1, wherein the damping space is in communication with the inlet chamber by way of a passage formed in the piston means.

8. A common rail fuel injection apparatus according to claim 1, wherein the piston means has a first end disposed towards the fuel outlet and a second end disposed towards the fuel inlet, and the damping space is in communication with the inlet chamber by way of a passage formed in the piston means at the second end thereof.

9. A common rail fuel injection apparatus according to claim 1, wherein the piston means is tubular and has a wall thickness smaller than the internal diameter of the piston means.

* * * * *